United States Patent [19]

Stone

[11] 3,963,173

[45] June 15, 1976

[54] RECLOSABLE CONTAINERS AND BLANKS THEREFOR

[76] Inventor: Orison W. Stone, Rte. 17, New Haven, Vt. 05472

[22] Filed: Sept. 17, 1974

[21] Appl. No.: 506,870

Related U.S. Application Data

[63] Continuation-in-part of Ser. No. 458,188, April 5, 1974.

[52] U.S. Cl. ..... 229/44 CB; 229/45 R

[51] Int. Cl.[2] ..... B65D 5/66

[58] Field of Search ..... 229/17, 44 CB, 45

[56] References Cited

UNITED STATES PATENTS

| | | | |
|---|---|---|---|
| 2,848,152 | 8/1958 | Geiger, Sr. | 229/17 |
| 2,848,153 | 8/1958 | Geiger, Sr. | 229/44 CB UX |
| 2,922,565 | 1/1960 | Roderich et al. | 229/44 CB |
| 2,963,213 | 12/1960 | Nauman | 229/44 CB |
| 3,794,238 | 2/1974 | Egli | 229/44 CB |

*Primary Examiner*—Davis T. Moorhead

*Attorney, Agent, or Firm*—Burns, Doane, Swecker & Mathis

[57] ABSTRACT

A paperboard blank for a flip-top container, a flip-top container and a method of assembly are disclosed. The containers feature an initially sealed flip-top separable along perforations accessibly disposed on the front panel of the container. When opened, the flip-top exposes an access cutout of an integral internal collar which increases the structural strength of the container at certain critical locations. Each side of the container is provided with a latch having mating portions which are detachably connected and thus positively aligned during all of the container assembly steps to eliminate registry problems between the mating portions of the latches.

7 Claims, 25 Drawing Figures

FIG.1
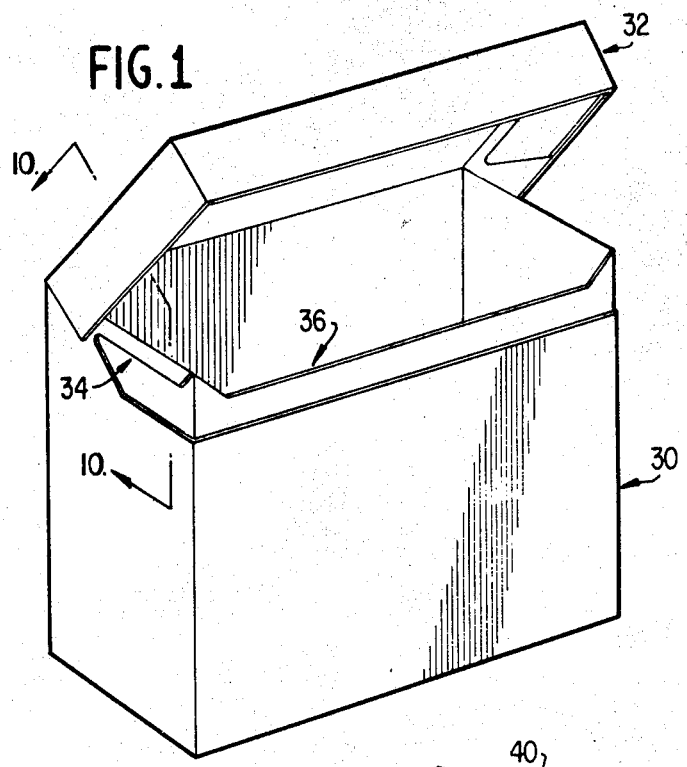
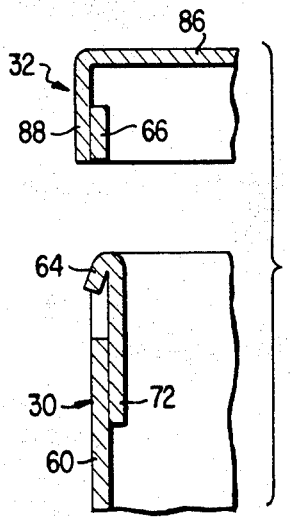
FIG.10
FIG.2
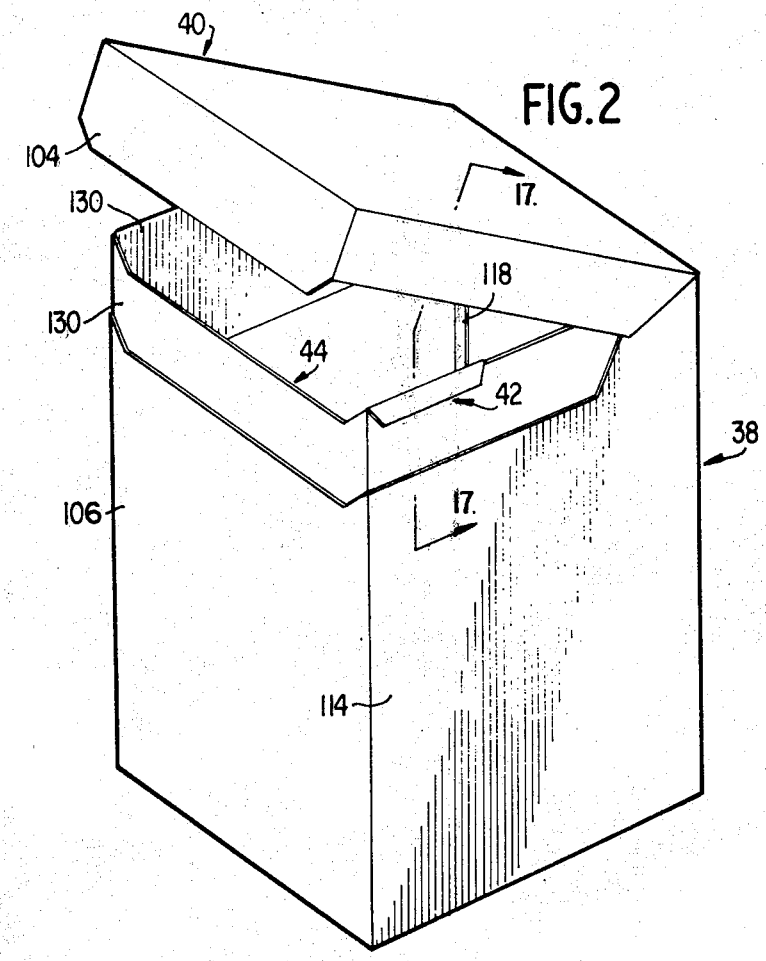
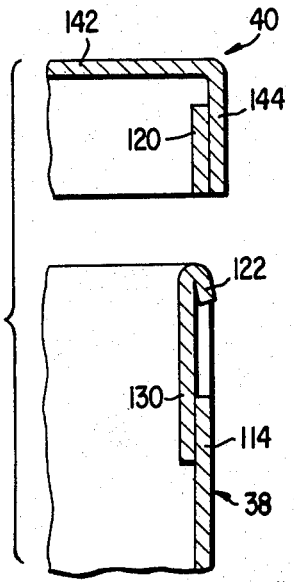
FIG.17

FIG.6
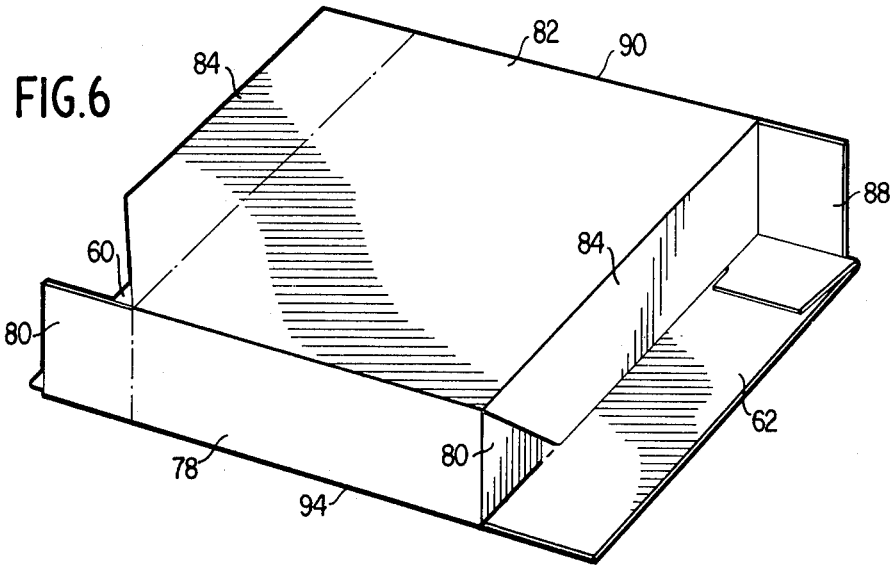
FIG.7
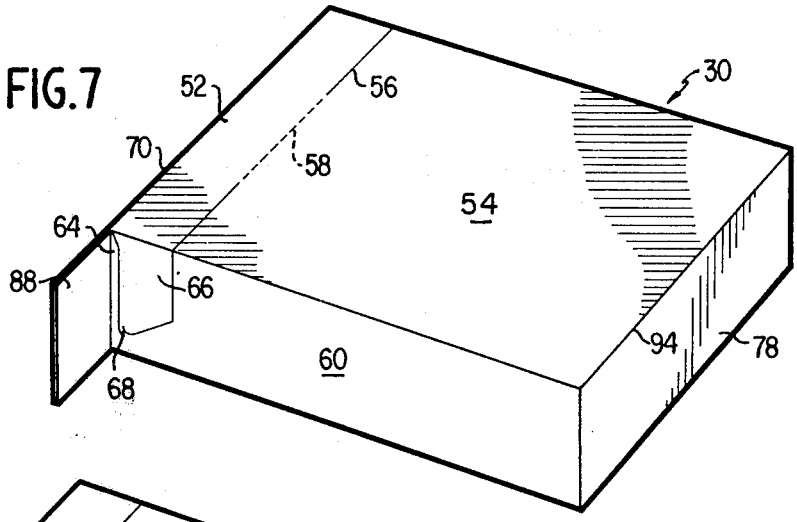
FIG.8
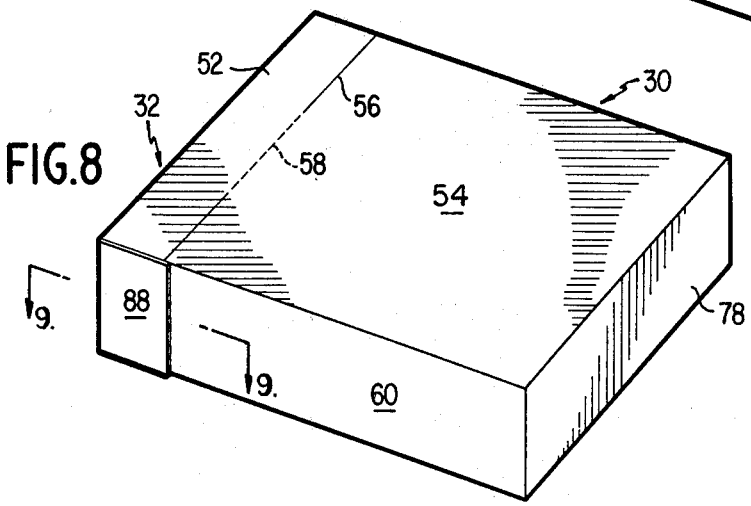
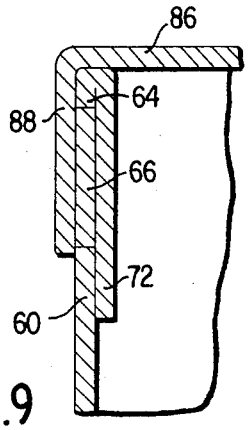
FIG.9

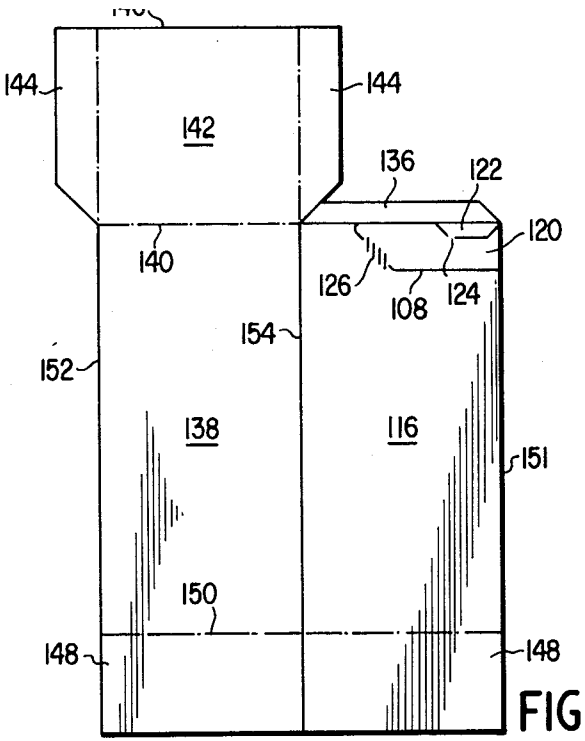
FIG.11
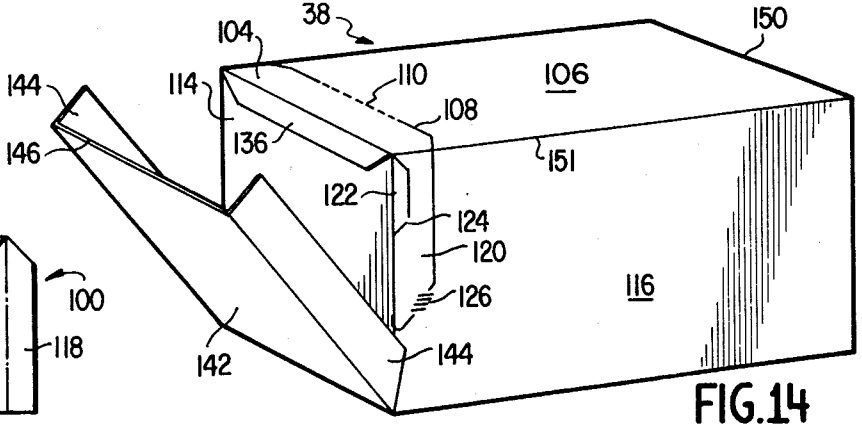
FIG.14
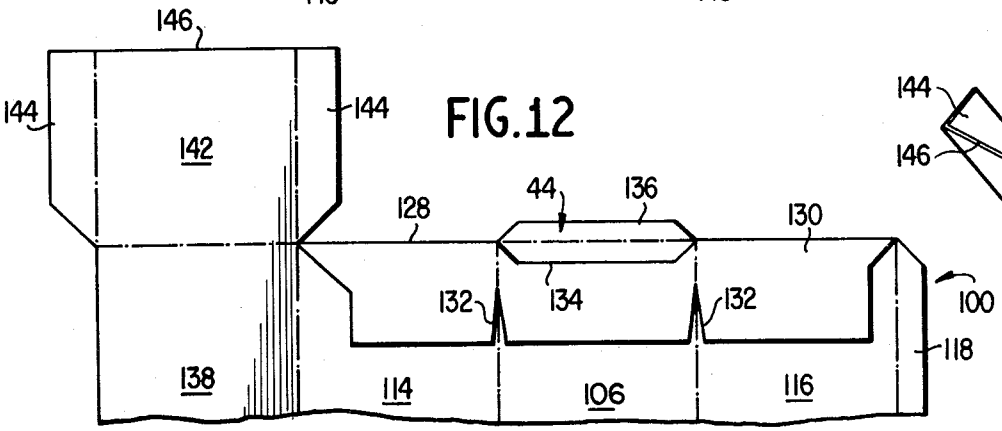
FIG.12
FIG.13

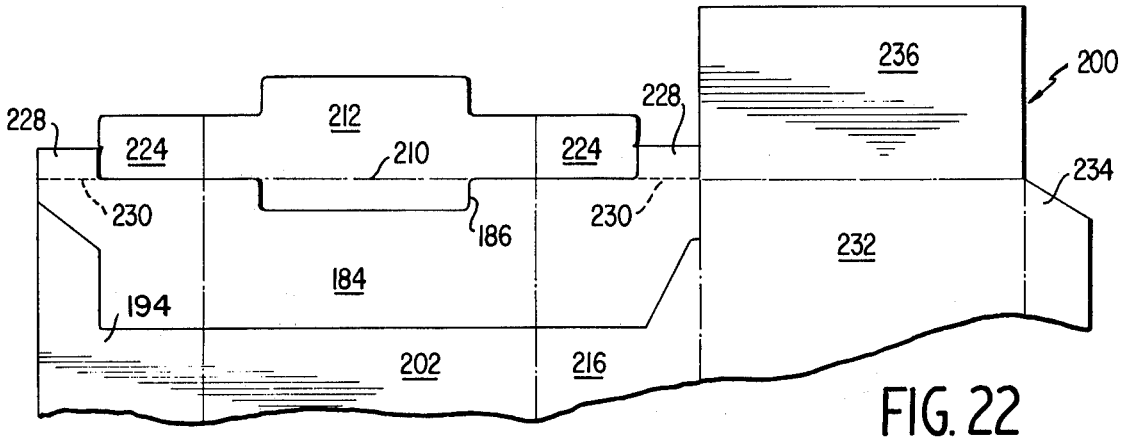
FIG. 22
FIG. 24
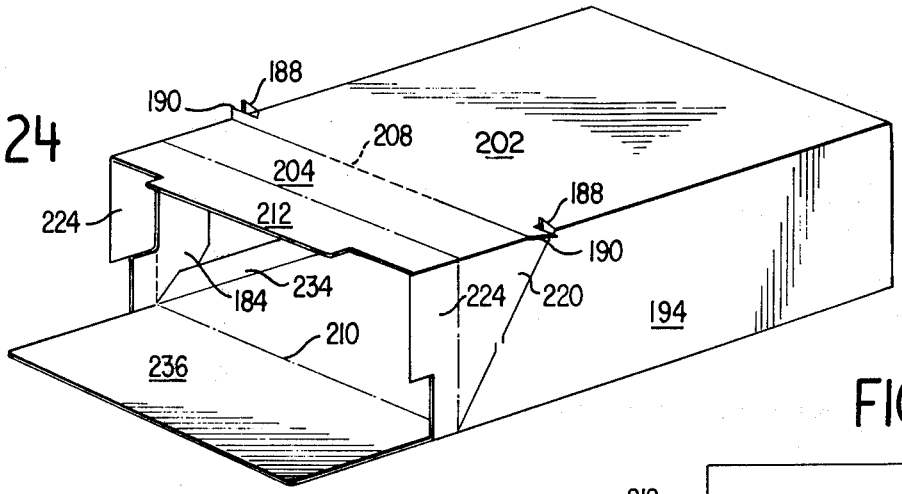
FIG. 23
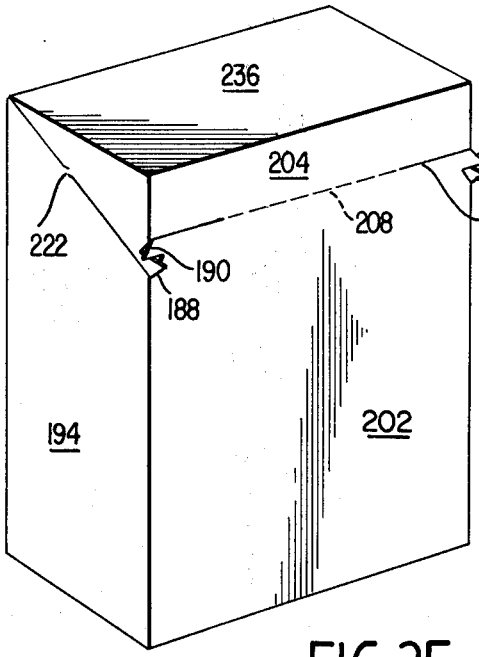
FIG. 25
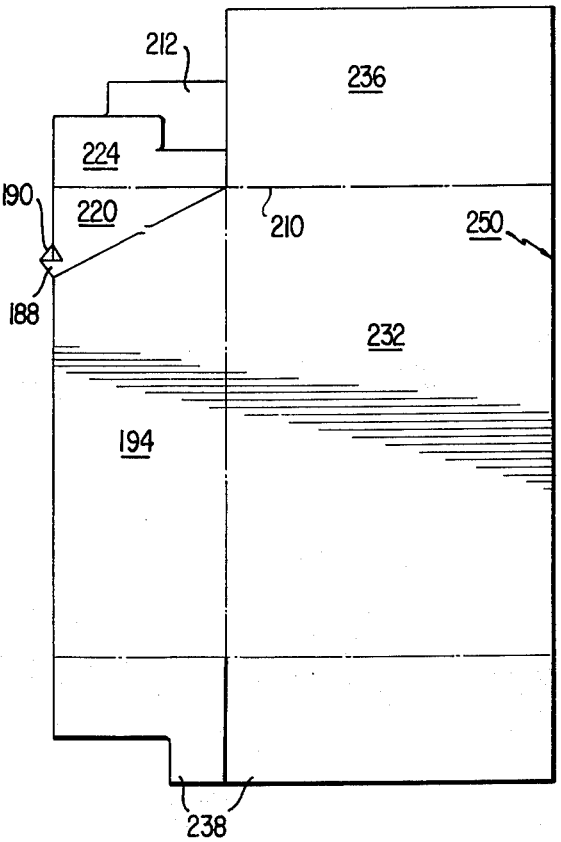

RECLOSABLE CONTAINERS AND BLANKS THEREFOR

CROSS REFERENCE TO RELATED APPLICATION

This application is a continuation-in-part of copending U.S. Pat. application, Ser. No. 458,188 filed Apr. 5, 1974 by Orison W. Stone for Recloseable Containers, Blanks, and Methods of Manufacture.

BACKGROUND OF THE INVENTION

1. Field of the Invention

This invention relates generally to both side and top filled flip-top paperboard containers, the blanks therefor, and method of assembly. More particularly, this invention is directed to an initially sealed flip-top container openable along exposed perforation lines to expose an access cutout of an integral internal collar and having positively prealigned latching surfaces, desirably on both side panels of the container.

2. Description of the Prior Art

Perforations are commonly utilized in the construction of initially sealed flip-top paperboard containers. Such perforations, however, are usually disposed in an inaccessible position such as an under-turned part of the flip-top. Such positioning of the perforations is inconvenient insofar as a consumer is concerned since it precludes the use of a thumbnail or other tool when the perforations are particularly resistant to rupture. In addition, the inability to use a thumbnail on the perforations in opening the container may require sufficient inward pressure to damage the contents of the container or to rupture an inner liner.

The use of perforations is necessary for flip-top container construction and, in the absence of a panel underlying or overlying such perforations, there is a substantial risk of leakage or product deterioration as a result of exposure to the air. The additional panels necessary to obviate this problem greatly increases the amount of paper necessary to form the blank.

Flip-top containers are often used in the marketing of tightly packed commodities. In such an application, these generally used containers have frequently been provided with a recess in the front of the container to provide ready access to the contents thereof. Typically, such a recess requires a cutout to achieve the access and an additional panel to provide the paper necessary for the manufacturer's glue seam. This results in the waste of paperboard material in forming the blank and may require additional steps in the container forming process.

The flip-top construction generally requires an internal collar to lend structural strength to the container at the top thereof. This internal collar has generally been formed from additional panels at the side or bottom of the blank. A substantial reduction in the paper requirements of the blank may be achieved by the location of the internal collar panels on the blank immediately adjacent the area where it will be utilized in the assembled container, i.e., at the top of the blank.

Various latching surfaces have been provided between a container and a flip-top hingedly attached thereto. Considering that automated machinery is normally employed to form the containers, it is apparent that cooperating latching surfaces of the flip-top and the associated container must be provided with loose tolerances to accommodate potential misalignment therebetween during formation of the container. Loose tolerances necessarily reduce the effectiveness of the latch to the annoyance of consumers. On the other hand, tight tolerances often accentuate the misalignment and poor registry of the cooperating latching surfaces as a result of which the latching surfaces may not cooperate to hold the flip-top closed on the container and result in spoilage.

The asembly of paperboard containers from paperboard blanks often requires specialized and expensive glueing machinery and this is particularly true with the more complex flip-top type of container. Since conventional glueing machinery is best suited for straight line or spot glueing, paperboard containers formed from blanks that require only conventional, or easily modifiable, glueing operations are desirable.

It is accordingly an object of the present invention to obviate these and other deficiencies of known flip-top containers and to provide a novel method of assembling flip-top paperboard containers with conventional glueing machinery.

It is another object of the present invention to provide a novel flip-top container in which the sealing perforations are readily accessible to the consumer on the front panel thereof.

Another object of the present invention is to provide a novel flip-top container having an efficiently designed internal collar facilitating access to the contents of the container while providing increased structural rigidity.

Still another object of the present invention is to provide a novel flip-top container blank in which the internal collar is located adjacent the flip-top portion thereof.

Yet another object of the present invention is to provide a novel flip-top container having positively aligned latching surfaces to hold the flip-top closed.

A further object of the present invention is to provide a novel flip-top container in which a pair of positively prealigned edges are disposed between each side of the container and the corresponding portion of the flip-top.

A still further object of the present invention is to provide a novel flip-top container which includes an integral and internally disposed collar providing access to the contents of the container while underlying or overlying all perforations.

Yet further object of the present invention is to provide a novel flip-top blank in which a glue flap for connecting the detachable portion of the front panel of the container to the flip-top is formed in the process of cutting an integral collar to define a finger access recess therein.

A yet still further object of the present invention is to provide a novel arrangement of latching tabs which cooperate with one another to retain the flip-top of a carton in a closed configuration.

Another object of the present invention is to provide a paperboard blank for a novel flip-top paperboard container including a novel arrangement of prealigned latching tabs and an internally disposed collar having a finger access recess therein.

Yet another object of the present invention is to provide a novel blank for a flip-top paperboard container which may be used by conventional double package making machinery without modification thereof.

These and many other objects and advantages of the present invention will be apparent to one skilled in the art to which the invention pertains when the appended claims are read in conjunction with the detailed description of preferred embodiments and the associated drawings.

BRIEF DESCRIPTION OF THE DRAWINGS

Three preferred embodiments of the invention are illustrated in the drawings wherein:

FIG. 1 is a pictorial view of an open paperboard container according to a first embodiment of this invention;

FIG. 2 is a pictorial view of an open paperboard container according to a second embodiment of this invention;

FIG. 6 is a pictorial view of the container of the first embodiment with a side partially closed;

FIG. 7 is a pictorial view of the container of the first embodiment prior to the last glueing step;

FIG. 8 is a pictorial view of a sealed container of the first embodiment;

FIG. 9 is a partial sectional view taken along line 9—9 of FIG. 8;

FIG. 10 is a partial sectional view taken along line 10—10 of FIG. 1;

FIG. 11 is a plan view of a paperboard blank for the second embodiment;

FIG. 12 is a partial plan view of the blank of FIG. 11 after a step in container formation;

FIG. 13 is a plan view of a semi-formed container of the second embodiment;

FIG. 14 is a pictorial view of the container of the second embodiment with the botton end closed;

FIG. 17 is a partial sectional view taken along line 17—17 of FIG. 2;

FIG. 22 is a partial plan view of the blank of FIG. 21 after a step in container formation;

FIG. 23 is a plan view of a semi-formed container of the third embodiment;

FIG. 24 is a pictorial view of the container of the third embodiment prior to the last glueing step; and FIG. 25 is a pictorial view of a sealed container of the third embodiment.

DETAILED DESCRIPTION OF THE INVENTION

Figure 4:
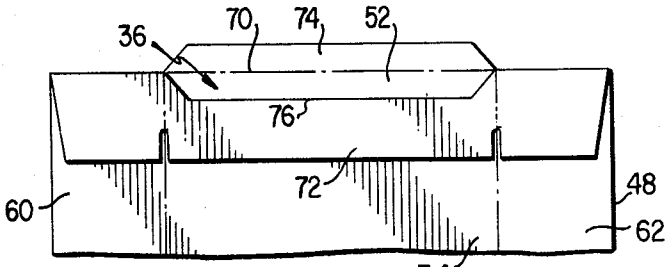
FIG. 4 is a partial plan view of the blank of FIG. 3 after a step in container formation.

Illustrated in FIG. 1 is an open paperboard container 30 which includes a hingedly mounted flip-top 32. At the top of each side panel of the container 30, a positively prealigned latching means 34 may be provided for releasably detaining the flip-top 32 in a closed configuration (see FIG. 8). The open container 30 of FIG. 1 also depicts a finger access cutout 36 which is exposed when the flip-top 32 is raised or opened.

Illustrated in FIG. 2 is a second embodiment of a paperboard container 38 having a hingedly mounted flip-top 40 which may be releasably detained in a closed configuration by positively prealigned latching means 42 disposed at the top of each side panel. The flip-top 40 also exposes a finger access cutout 44 when the container 30 is opened.

Figure 3:
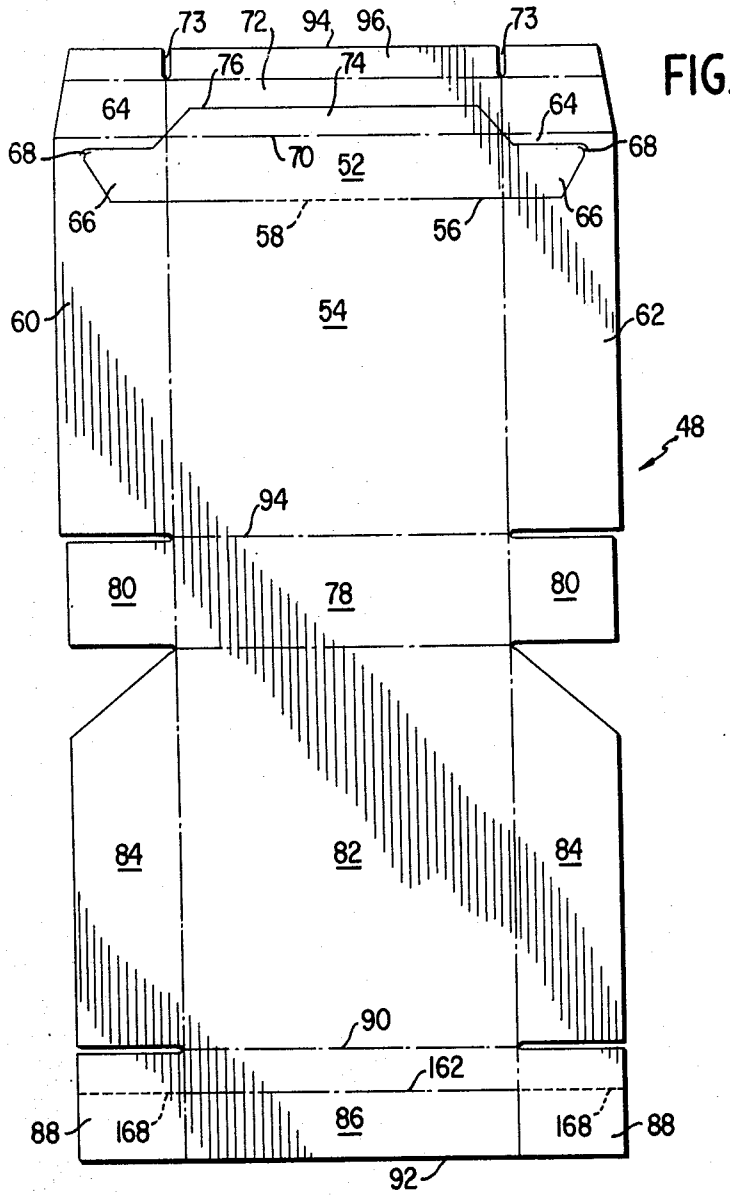
FIG. 3 is a plan view of a paperboard blank for the first embodiment.

In FIG. 3 a blank 48 for the formation of a side filled flip-top container is depicted. Typically, blanks for the side filled container 30 may be simultaneously die cut and creased with the detachable portions of the container typically formed by conventional apparatus.

The blank 48 includes a generally rectangular front panel which may comprise a generally rectangular detachable portion 52 and a generally rectangular container portion 54. The detachable portion 52 may be separated from the container portion 54 along a parting line 56 which may include one or more sections of perforations 58 for holding the detachable portion 52 and the container portion 54 together.

Extending above the top edge 70 of the detachable portion 52, a generally trapezoidal attachment flap 74 is provided. The attachment flap 74 is integrally connected to the detachable portion 52 and provides a glueing surface.

Integrally connected to each lateral edge of the front panel may be a rectangular side panel 60, 62. At the top or upper portion of each side panel 60, 62 and extending transversely thereof, a generally trapezoidal fixed latching tab 64 and a generally trapezoidal detachable latching tab 66 may be provided. Each detachable tab 66 is preferably connected to the upper portion of the corresponding side panel 60, 62 by one or more bridges 68. In addition, each detachable tab 66 may be integrally connected to a corresponding lateral edge of the detachable portion 52.

The combination of the perforations 58 and the bridges 68 serves to positively prealign the fixed latching tabs 64 with respect to the detachable latching tabs 66 while permitting close dimensional tolerances therebetween. The bridges 68 may also be used to accommodate and relieve any lateral stresses which tend to separate the detachable tabs 66 from the fixed tabs 64 in the forming operations.

With continued reference to FIG. 3 and preferably disposed adjacent the attachment flap 74 and both side panels 60, 62 is a generally trapezoidal collar panel 72 which may include U-shaped cutouts 73 along one edge to facilitate folding of the blank 48 to form a container. The collar panel 72 is integrally connected to the top or upper portion of each side panel 60, 62 and to each fixed latching tab 64. The attachment surface 74 and collar panel 72 may be separated by a cut line 76 which also defines the finger access cutout 36 of the container illustrated in FIG. 1. From FIG. 3 it is thus apparent that access cutout 36 does not result in the waste of any paperboard material from the blank 48.

The cut line 76 and the parting line 56 outline the detachable portion 52, the contiguous detachable flaps 66 and the attachment flap 74. While the cut line 76 and the parting line 56 may completely cut through the blank 48, in some applications it may be desirable to merely cut substantially through the blank 48 and thereby provide an integral surface which serves as a vapor barrier for the container.

Integrally connected to the bottom of front panel container portion 54 may be a generally rectangular bottom panel 78. At each lateral edge of the bottom panel 78, a quadrilateral flap 80 may be utilized to provide continuity between the bottom panel 78 and one corresponding side panel 60, 62 when the container is formed and glued.

Similarly, integrally connected to the bottom panel 78 may be a generally rectangular back panel 82 which may be provided with a generally trapezoidal flap 84 at each lateral edge. Each trapezoidal flap 84 seals the back panel 82 to a corresponding side panel 60, 62 when the container is formed.

At the bottom edge of the back panel 82 in the container blank, a generally rectangular top panel 86 may be provided. The top panel 86 is integrally connected to back panel 82 along hinge line 90 and includes a back edge along hinge line 90 and a front edge 92 at the lower extremity of the blank 48. At each lateral edge of the top panel 86, a quadrilateral flap 88 may be provided that is adapted to cooperate with a corresponding detachable latching tab 66 in an assembled container as will be explained subsequently in greater detail.

Having described the blank 48 for the first embodiment of the paperboard container, the fabrication of a flip-top container will now be discussed. As a first step, an adhesive may be placed on the uppermost portion 96 of the blank 48 at the upper extremity thereof. The portion 96 extends generally along the top edge 70 of front panel container portion 54 for a distance from the edge 70 at least equal to the distance between the edge 70 and the perforations 58 on the parting line 56.

The collar panel 72 may then be folded about the edge 70 and pressed against the front panel container portion 54 and side panels 60, 62. It should thus be apparent that the positioning of glue on the collar panel 72 is designed to prevent adhesion between the detachable portion 52 and the collar panel 72. The configuration of the top portion of the blank 48 at this point is illustrated in FIG. 4 where the attachment surface 74 may be seen as projecting from the edge 70. In addition, it will be noted that the collar panel 72, when folded, defines the finger access cutout 36 which is outlined by the line 76 along which the attachment flap 74 was cut from the flat blank 48 of FIG. 3.

Figure 5:
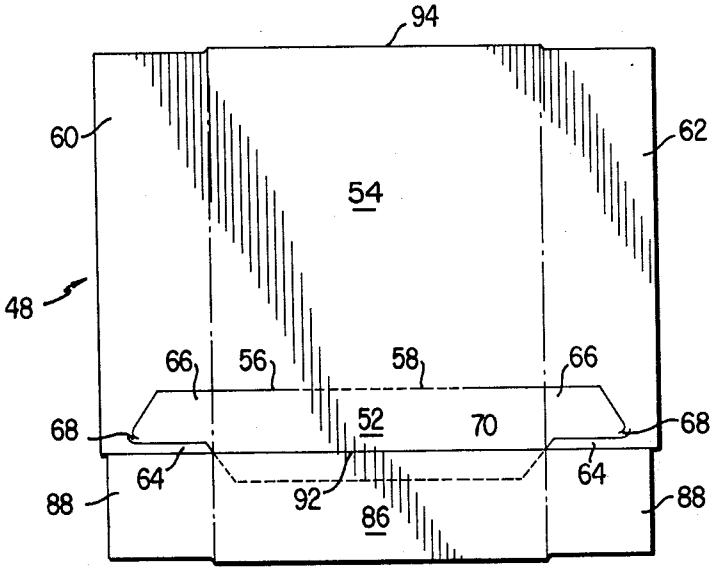
FIG. 5 is a plan view of a semi-formed container of the first embodiment.

With the blank 48 in the configuration illustrated in FIG. 4, a conventional straight line glueing machine may be used to apply a suitable adhesive to the under surface of the attachment flap 74 as shown in FIG. 4. After glue is applied to the abutment surface 74, the front panel container portion 54 may be folded about the lower edge 94 thereof (see FIG. 3) such that the front panel overlies the bottom panel 78 and a portion of the back panel 82. The top panel 86 may then be folded along the hinge line 90 such that the front edge 92 of the top panel 86 overlies the attachment flap 74 and effective bonding may take place therebetween. At this point, the configuration of the blank 48 is illustrated by FIG. 5. It is to be noted that FIG. 5 depicts a semi-formed blank 48 for a side filled paperboard container such as would normally be supplied to a commodity manufacture for filling and subsequent closing.

To close the side of a container, the semi-formed container illustrated in FIG. 5 is first "squared up" into a generally tubular configuration. Subsequently, (see FIG. 6) the flap 80 connected to the bottom panel 78 of the semi-formed blank may be folded 90° inwardly toward a corresponding open side. Next, the trapezoidal flap 84 extending from the back panel 82 may be folded 90° inwardly to partially overlap the flap 80. Glue may then be applied to the interior surface of side panel 62 with conventional glueing machinery. The side panel 62 may subsequently be folded 90° upwardly such that it overlies both the flap 80 and the trapezoidal flap 84 and is adhesively bonded to both.

Turning now to FIG. 7, the side filled container 30 is illustrated in position for the final glueing operation. Glue may be applied with conventional glueing machinery to the detachable latching tab 66. Glue repellant ink may first be applied to the upper portion of the side panel 60, 62 and to the fixed latching tab 64 so that glue may be applied to the entire area and produce adhesion only between the side flap 88 and the detachable latching tab 66. The glue may, of course, be applied to the side flap 88 or spot glueing techniques utilized to achieve the necessary adhesion between the side flap 88 and the detachable latching tab 66. After glue has been applied, the side flap 88 connected to the top panel 86 of the container 30 may be folded downwardly and pressed against the surface of detachable tab 66 for bonding thereto.

At the completion of the above described glueing operations, the side filled container 30 has its contents sealed therein and has the configuration illustrated in FIG. 8. From FIG. 8 it is apparent that the perforations 58 provided in the parting line 56 between the detachable portion 52 and the front panel container portion 54 are readily accessible to the ultimate consumer.

To open the closed container 30, the perforations 58 on the front panel must first be broken. In situations where the perforations 58 are particularly resistant to breaking, the consumer may apply a thumbnail or other suitable tool along the parting line 56 to sever the perforations 58. As the flip-top 32 is opened to the configuration illustrated in FIG. 1, the bridge 68 of each side panel 60 (see FIG. 7) is torn as the detachable latching tab 66 is lifted therewith.

Since the detachable latching tab 66 is bonded to the side flap 88 of the top panel 86 during sealing of the container 30, positive alignment of the detachable latching tab 66 with the cooperating fixed latching tab 64 of side panel 60 is assured despite relatively wide tolerances in the container forming operation.

As may be seen from FIG. 9, the detachable latching tab 66 must be displaced laterally outwardly to clear the fixed latching tab 64 of side panel 60 when the flip-top 32 is opened. With reference to FIG. 10, the detachable latching tab 66 and the fixed latching tab 64 are shown for an open container 30. The detachable tab 66 is depicted in position internally of the flap 88 of the flip-top 32. It will be noted that the fixed latching tab 64 may pivot slightly outwardly around the top edge of side panel 62 by the virtue of its integral connection with the internally disposed collar panel 72.

Turning now to FIG. 2, an open end filled fiberboard container 38 that may include a conventional seal end bottom is illustrated. To fabricate the container 38 a die cut blank 100, as illustrated in FIG. 11, may be provided. Necessary cuts and perforations of the blank 100 may be made in any suitably conventional manner. In some applications such as foodstuff packaging, it may be desirable to provide a vapor barrier for the container 38. Accordingly, certain cuts and perforations of the blank 100 may be incompletely made to permit a thin continuous surface to remain.

The blank 100 includes a centrally disposed generally rectangular front panel which comprises a generally rectangular detachable portion 104 and a generally rectangular container portion 106. Disposed adjacent the top edge 128 of the detachable portion 104, a generally trapezoidal attachment flap 136 is provided. The attachment flap 136 facilitates subsequent assembly of a container from the blank 100.

The detachable portion 104 and the fixed portion 106 lie on opposite sides of a parting line 108 which preferably includes one or more perforated sections 110. It will be noted from FIG. 11 that the parting line 108 need not be straight and may be provided with an offset which defines a generally trapezoidal lip 112 on the detachable portion 104.

Integrally connected to each lateral edge of the front panel may be a side panel 114, 116. One side panel 116 may be provided at its other lateral edge with a glue tab 118 which facilitates fabrication of a semiformed container. Each side panel 114, 116 includes a top or upper portion 117 and is preferably provided at its top edge with a generally trapezoidal detachable latching tab 120 and a generally trapezoidal fixed latching tab 122. The detachable latching tab 120 may be releasably connected to the upper portion 117 of the side panel 114, 116 by at least one bridge 126 to accommodate limited transverse movement of the detachable latching tab 120 with respect to the corresponding side panel 114, 116 during the container forming process.

The fixed latching tab 122 is preferably positively aligned with respect to the corresponding detachable latching tab 120 and may be provided with a bridge 124 to temporarily maintain a connection therebetween. As illustrated in FIG. 11, the fixed latching tab 122 may be spaced from the upper portion 117 of the corresponding side panel 114, 116.

Disposed adjacent to the top edge 128 of both side panels 114, 116 and the attachment flap 136, a collar panel 130 is provided. The collar panel is integrally connected to the upper portion 117 of each side panel 114, 116 and to an edge of each fixed latching tab 122. The upper edge of the blank 100 and the corresponding edge of the collar panel 130 may include a pair of relatively deep generally V-shaped notches 132. Each notch 132 may be positioned in general alignment with a lateral edge of the front panel container portion 106 to facilitate folding of the container blank 100 as will be described. It will be seen from FIG. 11 that the collar panel 130 and the attachment flap 136 are disposed on opposite sides of a cut line 134.

Integrally connected to a lateral edge of one side panel 114 may be a generally rectangular back panel 138. The top edge of the back panel 138 preferably comprises a hinge line 140 to which a generally rectangular top panel 142 is integrally connected. The lateral edges of the top panel 142 are preferably provided with a generally trapezoidal side flap 144 adapted for attachment to a corresponding detachable tab 120. The uppermost edge 146 of the top panel 142 comprises the front edge of an end filled flip-top container as will later become apparent.

The front panel 102, the side panels 114, 116 and the back panel 138 may each be provided with a rectangular bottom flap 148 integrally connected to the bottom edge 150 thereof. The bottom flaps 148 may thus comprise a conventional seal end. Alternatively, other conventional bottom closures may be utilized.

The first step in the formation of a container from the blank 100 comprises folding the collar panel 130 downwardly to partially overlie the front panel container portion 106 and the side panels 114, 116 along the top edge 128 thereof. The blank 100 then resembles the configuration illustrated in FIG. 12 in which the attachment surface 136 projects from the top edge 128.

The finger access cutout 44 of FIG. 2 may be most clearly seen in FIG. 12 to be defined by the cut line 134 of the collar panel 130. The portions of the collar panel 130 which overlie the side panels 114, 116 may be glued, or otherwise adhesively bonded, to the corresponding side panels 114, 116. However, it is to be noted that adhesion of the collar panel 130 to the respective panels 106, 114, 116 is not necessary to construct a container according to either embodiment of the invention herein disclosed.

Preferably, the notches 132 of the collar member 130 do not project above the parting line 108 between the detachable portion 104 and the container portion 106 of the front panel.

Next, the glue tab 18 may be provided with a suitable adhesive on the under surface thereof by means of conventional glueing machinery. Subsequently, the side panel 116 is folded along the lateral edge 115 thereof into overlying relationship with respect to the front panel. Then, the back panel 138 is folded along the edge 152 contiguous with the side panel 114 such that the back panel 138 overlies the side panel 114. The portion of the back panel 138 adjacent the other edge 154 thereof is thus brought into an overlapping relationship with the surface of glue tab 118 and secured thereto. Accordingly, the container blank 100 comprises a flat semi-formed end filled container (see FIG. 13) which may be shipped to commodity manufacturers for subsequent filling and sealing.

Prior to filling, the semi-formed container is "squared up" to a generally tubular configuration. The bottom may then be sealed in a conventional manner to provide a seal end carton having an open top. Alternatively, the flip-top end of the container 38 may be sealed first.

To seal the flip-top end of the container 38 (see FIG. 14), the top panel 142 and the side flaps 144 may be adhesively bonded to the container 138. To accomplish this bonding, the top surface of attachment flap 136 may be provided with glue, or other suitable adhesive, by a conventional straight line glueing machine. The portion of the top panel 142 adjacent the front edge 146 may then be brought into overlapping engagement with the attachment flap 136 for adhesive bonding therebetween.

Figure 15:
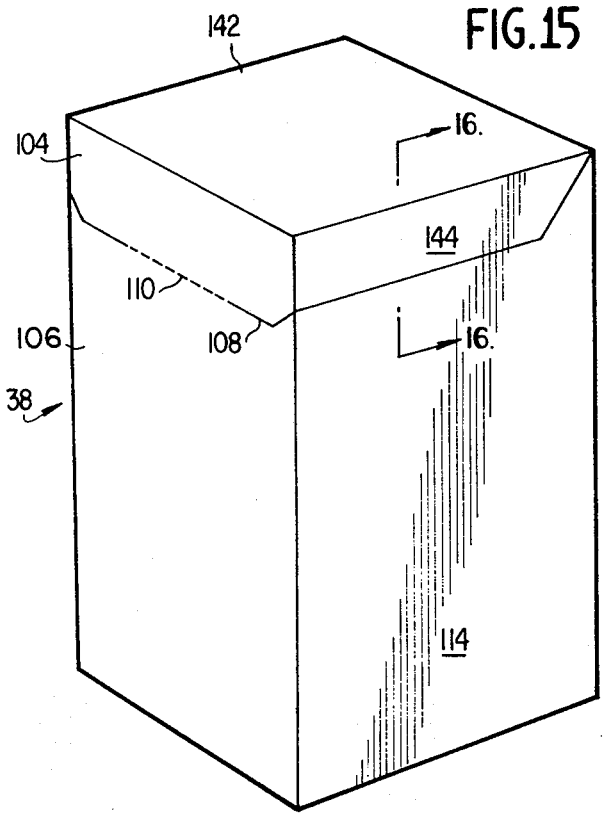
FIG. 15 is a pictorial view of a sealed container of the second embodiment.

Subsequently, glue may be applied to the detachable latching tabs 120 disposed on each side panel 114, 116 of the container 38. As discussed above in connection with the sealing of the side filled container, glue may be applied by conventional spot glueing apparatus or by inking the portions of the side panel which are not to receive glue. The configuration of the container 38 resembles FIG. 15 when the side flaps 144 have been bonded thereto.

Figure 16:
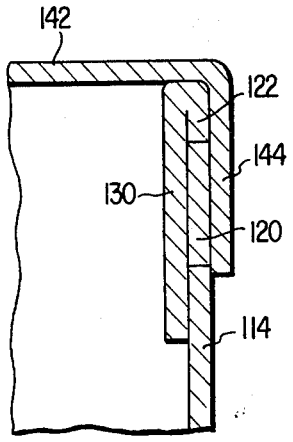
FIG. 16 is a partial sectional view taken along line 16—16 of FIG. 15.

The fixed latching tab 122 and the associated detachable latching tab 120 on each side panel of the container 38 comprise the positively prealigned latching means 42 generally illustrated in FIG. 2. FIG. 16 best illustrates the relative positioning of the fixed latching tab 122 and the associated detachable latching tab 120 when the tip of a container is closed and when the container 38 is first sealed.

The container 38 of FIG. 2 initially opened in the same manner as discussed above with respect to the embodiment of FIG. 1. The relatonship between the latching tabs 120, 122 when the container is opened is best illustrated by FIG. 4. It will be noted that the fixed latching tab 122 may freely pivot outwardly with respect to the container 38 by virtue of the integral connection with the collar panel 130.

Figure 18:
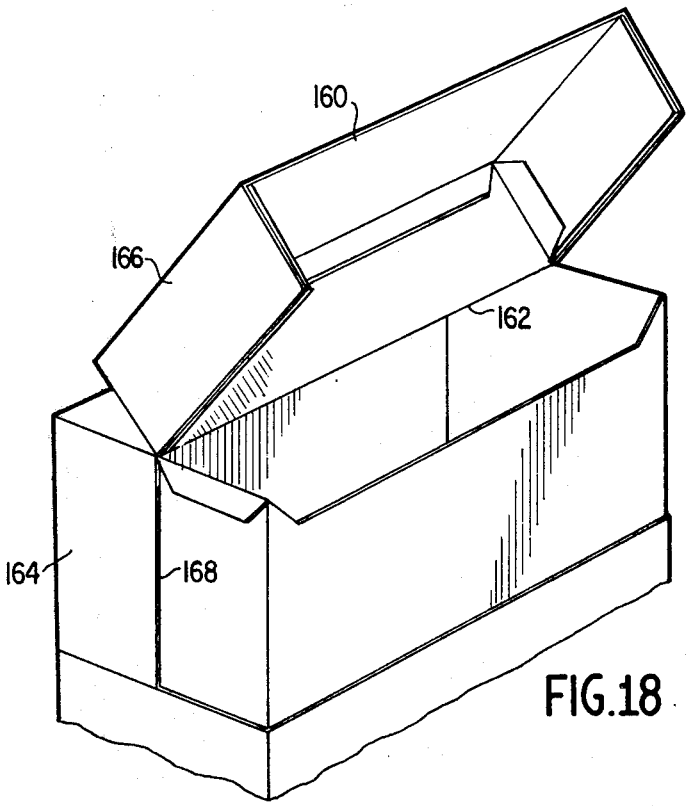
FIG. 18 is a pictorial view of a modified flip-top for a paperboard container according to this invention.

The present invention is also useful with a modified flip-top container as illustrated in FIG. 18. Referring to FIG. 18, the flip-top 160 may not extend the entire depth of the container but may be pivoted about a hinge line 162 also shown on the blank illustrated in FIG. 3. The necessary separation between the two portions 164 and 166 of the side flaps of the flip-top 160 may be achieved through the use of perforations along the line 168 of the blank illustrated in FIG. 3.

With this modification, it is also desirable to modify the shape of the fixed latching tab to conform to the shape generally indicated in FIG. 18, but the container forming process may be the same as that earlier described. The necessity for glue repellent ink may thereby be obviated.

Figure 19:
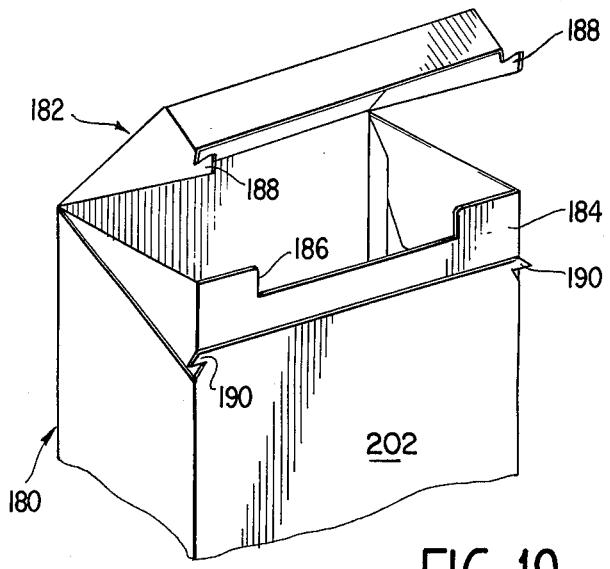
FIG. 19 is a partial pictorial view of an open paperboard container according to a third embodiment of the invention.

Illustrated in FIG. 19 is a third embodiment of the present invention comprising an open, paperboard container 180 having a hingedly mounted flip-top 182. At the open end of the container 180 an internally disposed collar 184 and a finger access recess 186 are provided. Both the collar 184 and the recess 186 are similar to the corresponding features of the first and second embodiments of the present invention. Disposed along the front edge of each side of the flip-top 182 and adjacent the bottom edge thereof is a latching tab 188 which cooperates with latching tabs 190 provided on a front panel container portion 202 of the container 180.

Figure 20:
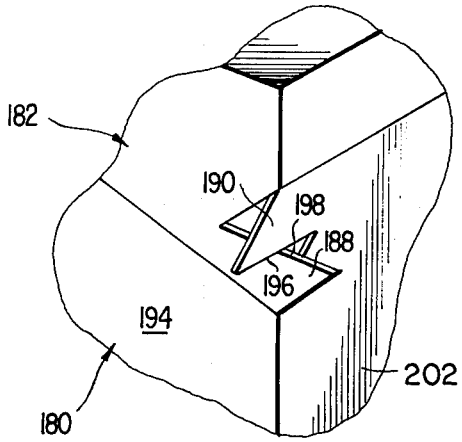
FIG. 20 is an enlarged partial pictorial view of the latching assembly of FIG. 19.

The cooperative relationship in addition to the spatial relationship between each latching tab 188 carried by the flip-top 182 and each latching tab 190 carried by the front panel container portion 202 may easily be seen in FIG. 20 where the flip-top 182 is illustrated in closed relationship with respect to the container portion of the container 180. More specifically, latching tab 188 carried by the flip-top 182 projects forwardly beyond the plane of the front panel and is an integral coplanar extension of a side panel 194. Analogously, each latching tab 190 projects laterally beyond the plane of a side panel and comprises a coplanar extension of front panel container portion 202. Each latching tab 190 includes a lower edge 196 which cooperates with an upper edge 198 of the adjacent latching tab 188 to releasably latch the flip-top 182 in a closed relationship with respect to the container 180.

While the latching tabs 188, 190 are illustrated in the drawings as being generally triangular in configuration, the tabs might have a semicircular, semi-elliptical or any other suitable configuration.

Figure 21:
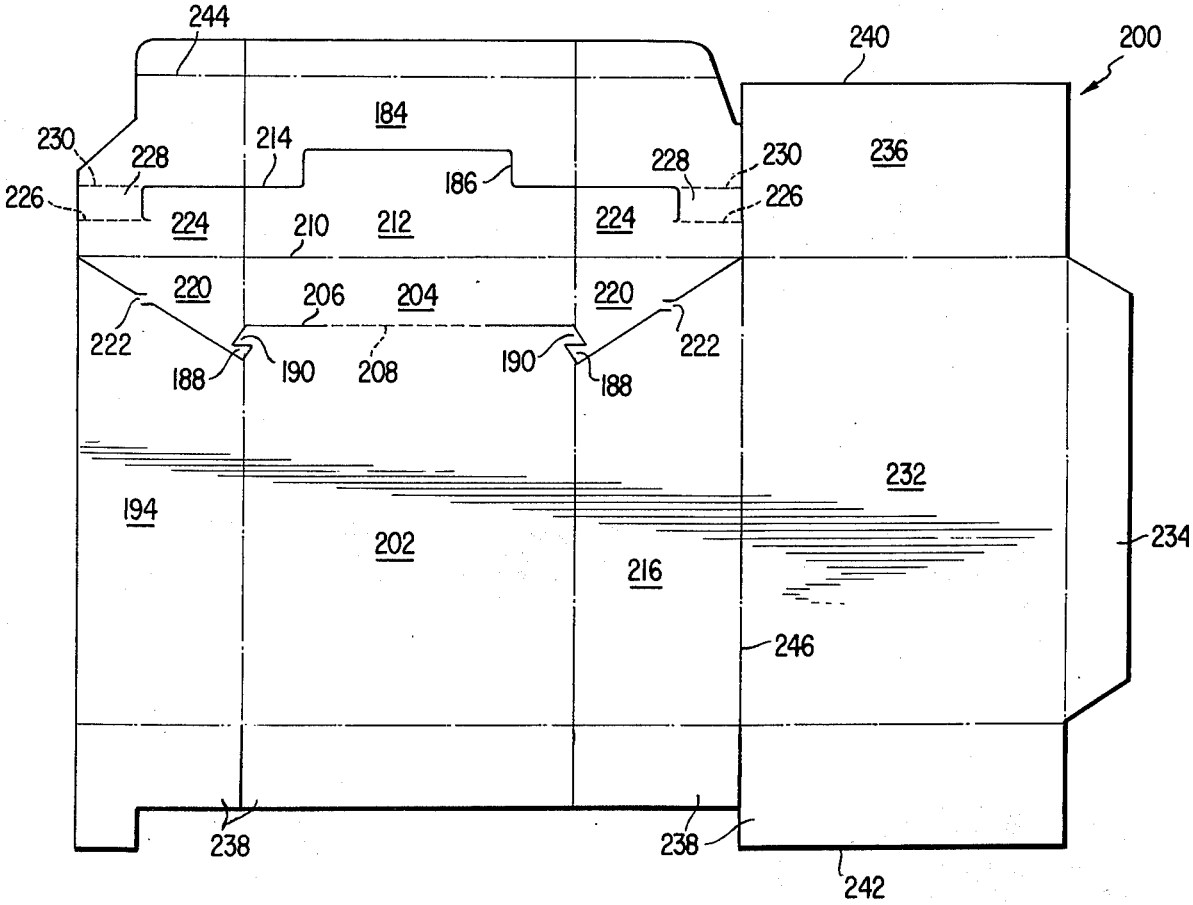
FIG. 21 is a plan view of a paperboard blank for the third embodiment.

In FIG. 21, a paperboard blank 200 for the formation of an end-filled flip-top container is depicted. As was the case with the first and second embodiments, blanks for end filled container 180 may be simultaneously die cut and creased with detachable portions of the container being formed by conventional cutting and creasing apparatus.

The blank 200 includes a generally rectangular front panel which may comprise the generally rectangular container portion 202 and generally rectangular detachable portion 204.

The detachable portion 204 and the container portion 202 are separable along a parting line 206 which includes perforations 208 generally centrally thereof. The perforations are operable to hold the detachable portion 204 in position with respect to the container portion 202 of the front panel during formation of a container from the blank 200.

Extending above the detachable portion 204 and integrally connected thereto along a crease line 210 is front panel top flap 212. Adjacent the front panel top flap 212 and separated therefrom by a cut line 214 is a collar panel 184. The cut line 214 may define the finger access cutout 186 in the collar 184 such that paperboard material separated therefrom constitutes a portion of the flap 212. The flap 212 provides a gluing surface for a conventional seal end carton as will become apparent hereinafter.

Integrally connected along each side of the front panel may be a generally rectangular side panel 194, 216. Each side panel 194, 216 includes a generally trapezoidal container portion and a generally triangular detachable portion 220. Each detachable portion 220 is separated from the corresponding container portion by the parting line 206 which may include one or more bridge portions 222 to maintain the proper physical alignment between the detachable portion 220 and the corresponding body portion 218. Each detachable portion 220 of the side panels 194, 216 is integrally connected to the detachable portion 204 of the front panel. Similarly, the container portion of each side panel 194, 216 is integrally connected to the container portion 202 of the front panel.

It will also be noted from FIG. 21 that the parting line 206 defines both the latching tab 188 carried by the detachable portion 220 of each side panel 194, 216 and the latching tab 190 carried by the body portion 202 of the front panel. The combination of the perforations 208 and the bridges 222 positively prealign the latching members 188, 190 which preferably are symmetrically disposed with respect to the front panel.

Extending above the crease line 210 and integrally connected with each detachable portion 220 is a side panel top flap 224. The side panel top flaps 224 are symmetrically disposed with respect to the front panel flap 212 and are defined in part by the cut line 214, and in part by a fold line 226. The fold line 226 in combination with the cut line 214 defines a pair of tabs 228 each of which are integrally connected to a corresponding side panel flap 224 along the fold line 226 and each of which are detachably connected to the collar panel 184 along a perforated line 230.

Adjacent the side panel 216 and integrally connected thereto is a generally rectangular back panel 232 that includes an integral glue flap 234 which extends from a lateral edge parallel to the side panel 216. From the top of the back panel 232 along the crease line 210, there extends a generally rectangular top panel 236 which is integrally connected to the back panel 232.

Extending downwardly from the bottom edge of the front panel container portion 202, each side panel 194, 216 and the back panel 232 is a corresponding bottom end flap 238. The bottom end flaps 238 comprise a convention seal end bottom for the container blank 200.

It should be noted that the proportions of the various panels described above may be altered as desired to obtain a container having the appropriate dimensions for particular packaging applications. Moreover, visual comparison of the similarity between the top edge 240 and the bottom edge 242 of the blank 200 will reveal that a series of blanks 200 may be cut from a sheet of paperboard stock with a minimum amount of waste thereby maximizing use of the stock and reducing cost for containers.

Having described the blank 200, the fabrication of a paperboard container from a blank will now be described. With combined reference to FIG. 21, a glue or any suitable adhesive may be applied to the uppermost portion of the collar 184 between the top edge 240 of the blank 200 and a line 244. The line 244 may be generally parallel to the crease line 210 and laterally spaced from the fold lines 226 by a distance as least as great as the distance from the bottom of latching tab 188 to the fold line 226. In this manner, when the collar 184 is folded, there will be no glue between the collar 184 and the detachable portions of the blank 200 which are adjacent to the parting line 206.

Subsequently, the collar panel 184 is folded along the fold lines 226 into overlying relationship with respect to the front panel container portion 202 and the side panels 194, 216 (see FIG. 22). It will be noted that the perforations 230 between the collar 184 from each detachable tab 228 are in overlying relationship with respect to the crease line 210. Moreover, the collar 184 completely covers the parting line 206 between detachable portions and container portions of the front panel and the side panels 194, 216. The continuous panel defined by the collar 184 thus underlies the parting line 206 along the entire length thereof and thereby facilitates sealing a container and its contents.

With the collar 184 folded and glued as illustrated in FIG. 22, the blank 200 may be shipped directly to packagers. The blank 200 is suitably adapted for use on conventional double package maker machinery without modification of the machinery. The double package maker machinery forms, folds and glues paperboard containers having conventional seal-ends from flat blank. Accordingly, a blank as illustrated in FIG. 22 may be handled by such machinery to provide a flip-top carton from a flat blank. Such a blank thus requires only minimal processing other than cutting while retaining the advantages of a recloseable flip-top carton.

Alternatively, the blank 200 of FIG. 22 may be formed into a semiformed container by first placing a suitable adhesive on the bottom side of the glue flap 234. Subsequently, the back panel 232 may be folded about a score line 246 between the back panel 232 and the adjacent side panel 216. Next, the second side panel 194 is folded about a score line 248 between the side panel 194 and the front panel into overlapping relationship with the glue flap 234 such that a semiformed end-filled container blank 250 (see FIG. 23) results.

The blank 250 may be formed into a container by using conventional seal end container closing apparatus to close the ends of a generally tubular member obtained from the blank. Initially, the bottom flaps 238 are sealed to form a closed bottom. With the bottom closed, the blank 250 resembles the configuration illustrated in FIG. 24.

The open-ended carton illustrated in FIG. 24 may be filled with goods that are to be packaged for sale. Subsequently, the top end panels 212, 224, 236 which comprise a conventional seal end are folded and glued to close the container. The completed container will have a configuration such as that illustrated in FIG. 25.

Thus, it is apparent that there has been provided in accordance with the invention, a flip-top paperboard container that substantially satisfies the objects and advantages set forth above. Although the present invention has been described in conjunction with specific embodiments thereof, it is evident that many alternatives, modifications, variations, and equivalents will be apparent to those skilled in the art in light of the foregoing and the appended claims. Accordingly, it is expressly intended that all such alternatives, modifications, variations and equivalents which fall within the sprit and scope of the invention as defined in the appended claims, be embraced thereby.

What is claimed is:

1. A paperboard blank for a paperboard container comprising:

a front panel which includes a detachable portion and a front panel top flap integrally connected to said detachable portion at the upper extremity of said front panel;

a pair of side panels, each side panel being integrally connected to said front panel and including a detachable portion at the upper extremity of said side panel;

a back panel integrally connected to one of said side panels;

a top panel integrally connected to said back panel at the upper extremity thereof;

a pair of side panel top flaps, each side panel top flap integrally connected to the detachable portion of each side panel, being positioned at the upper extremity thereof and having a height substantially less than the top panel; and a collar disposed adjacent said front panel top flap, including a pair of tabs, and a finger access cut out defined by a single cut line separating the collar from the front panel top flap, each tab being hingedly connected to one of said side flaps.

2. The paperboard blank of claim 1 including:

a lower portion of said front panel separated from said detachable portion by a parting line;

a first latching tab disposed adjacent said parting line, being an integral portion of said lower portion and extending into the detachable portion of one of said pair of side panels such that a notch is defined therein; and a second latching tab disposed adjacent said first latching tab, being an integral portion of the detachable portion of one of said pair of side panels, and extending into said lower portion such that a notch is defined therein.

3. The blank of claim 2 including:

a third latching tab disposed adjacent said parting line, being an integral portion of said lower portion and extending into the detachable portion of the other of said pair of side panels such that a notch is defined therein; and a fourth latching tab disposed adjacent said third latching tab, being an integral portion of the detachable portion of said other of said pair of side panels, and extending into said lower portion such that a notch is defined therein.

4. The blank of claim 3 wherein said first tab and said third tab are symmetrically disposed with respect to said front panel.

5. The blank of claim 1 wherein said front panel includes a lower portion separated from said detachable portion by a parting line;

wherein said parting line extends from said front panel across each of said pair of side panels and defines the detachable portion thereof; and wherein said collar partially overlies the upper extremity of said pair of side walls and the upper extremity of said front panel such that said parting line is covered thereby.

6. The blank of claim 5 wherein said collar is glued to said lower portion of the front panel.

7. The blank of claim 5 wherein said parting line defines a first pair of latching tabs and a second pair of latching tabs, said first pair of latching tabs being symmetrically disposed with respect to said lower portion adjacent said parting line, each latching tab projecting into the detachable portion of the corresponding side panel, and said second pair of latching tabs being symmetrically disposed with respect to said lower portion, each latching tab of said second pair being adjacent a latching tab of said first pair, extending into said lower portion, and integral with the detachable portion of one side panel.

* * * * *